US010279365B2

(12) United States Patent
VanEvery

(10) Patent No.: US 10,279,365 B2
(45) Date of Patent: May 7, 2019

(54) THERMAL SPRAY METHOD INTEGRATING SELECTED REMOVAL OF PARTICULATES

(71) Applicant: Progressive Surface, Inc., Grand Rapids, MI (US)

(72) Inventor: Kent VanEvery, Grand Rapids, MI (US)

(73) Assignee: Progressive Surface, Inc., Grand Rapids, MI (US)

( * ) Notice: Subject to any disclaimer, the term of this patent is extended or adjusted under 35 U.S.C. 154(b) by 217 days.

(21) Appl. No.: 14/560,456

(22) Filed: Dec. 4, 2014

(65) Prior Publication Data

US 2015/0086725 A1 Mar. 26, 2015

Related U.S. Application Data

(63) Continuation-in-part of application No. 14/458,694, filed on Aug. 13, 2014, now abandoned, which is a (Continued)

(51) Int. Cl.
*B05B 12/08* (2006.01)
*C23C 4/134* (2016.01)

(Continued)

(52) U.S. Cl.
CPC ..... *B05B 12/082* (2013.01); *B05B 7/149* (2013.01); *B05B 7/166* (2013.01); *B05D 1/10* (2013.01);

(Continued)

(58) Field of Classification Search
CPC ..... C23C 4/134; C23C 4/12; C23C 4/129; C23C 4/02; C23C 4/18; B05B 12/082;

(Continued)

(56) References Cited

U.S. PATENT DOCUMENTS 3,900,639 A 8/1975 Lauterbach
4,696,855 A 9/1987 Pettit et al.

(Continued)

FOREIGN PATENT DOCUMENTS

BY 16430 C1 10/2012
WO 02/09894 * 2/2002
WO 2004028222 A1 4/2004

OTHER PUBLICATIONS

Fauchais, et al "Parameters Controlling Liquid Plasma Spraying: Solutions, Sols, or Suspensions", Journal of Thermal Spray Technology, vol. 17(1) Mar. 2008, pp. 31-59.*

(Continued)

*Primary Examiner* — Katherine A Bareford
(74) *Attorney, Agent, or Firm* — Price Heneveld LLP

(57) ABSTRACT

A thermal spray system and method includes a hot gas generator with nozzle accelerating heated gas towards a substrate in the form of a gas column projecting onto the substrate surface as a spot. One or more feedstock injectors proximate the nozzle exit, directed towards the gas column, are connected to a feedstock source. The hot gas stream transfers heat and momentum to the feedstock, causing the feedstock particles to impact onto a substrate to form a coating. The system further comprises one or more liquid injectors proximate the nozzle exit, directed towards the axis, and connected to a source of liquid. The system controls the flow and velocity with which the liquid is injected, permitting control of the depth of penetration of the liquid into the gas column. The method selectively prevents suboptimal feedstock particulates from adhering to the substrate and provides for the in-situ removal of suboptimal deposits.

13 Claims, 3 Drawing Sheets

Related U.S. Application Data continuation of application No. 13/826,252, filed on Mar. 14, 2013, now abandoned.

(60) Provisional application No. 61/639,471, filed on Apr. 27, 2012.

(51) Int. Cl.

| | |
|---|---|
| ***C23C 4/129*** | (2016.01) |
| ***C23C 4/18*** | (2006.01) |
| ***B05B 7/16*** | (2006.01) |
| ***B05D 1/10*** | (2006.01) |
| ***B05B 7/14*** | (2006.01) |
| ***B05D 3/00*** | (2006.01) |
| ***B08B 3/02*** | (2006.01) |
| ***B08B 5/02*** | (2006.01) |

(52) U.S. Cl.

CPC ..... *B05D 3/002* (2013.01); *B08B 3/026* (2013.01); *B08B 5/02* (2013.01); *C23C 4/129* (2016.01); *C23C 4/134* (2016.01); *C23C 4/18* (2013.01)

(58) Field of Classification Search

CPC ..... B05B 7/166; B05B 7/149; B08B 5/02; B08B 3/026; B05D 3/002; B05D 1/10

See application file for complete search history.

(56) References Cited

U.S. PATENT DOCUMENTS

| | | | | |
|---|---|---|---|---|
| 4,770,109 | A | 9/1988 | Schlienger | |
| 5,372,857 | A * | 12/1994 | Browning | B05B 7/205 239/79 |
| 5,934,566 | A | 8/1999 | Kanno et al. | |
| 6,114,649 | A | 9/2000 | Delcca | |
| 6,592,947 | B1 * | 7/2003 | McCane | C23C 2/26 427/191 |
| 7,112,758 | B2 | 9/2006 | Ma et al. | |
| 2004/0076751 | A1 | 4/2004 | Sherman | |
| 2004/0203251 | A1 | 10/2004 | Kawaguchi et al. | |
| 2006/0222777 | A1 * | 10/2006 | Skoog | B05B 7/201 427/446 |
| 2006/0278254 | A1 | 12/2006 | Jackson | |
| 2007/0084244 | A1 | 4/2007 | Rosenflanz et al. | |
| 2007/0199824 | A1 | 8/2007 | Hoerr et al. | |
| 2008/0072790 | A1 | 3/2008 | Ma et al. | |
| 2009/0241496 | A1 * | 10/2009 | Pintault | C23C 4/11 55/524 |
| 2009/0324971 | A1 | 12/2009 | DeVries et al. | |
| 2011/0006034 | A1 | 1/2011 | Hilkene et al. | |
| 2013/0284203 | A1 * | 10/2013 | VanEvery | B08B 3/026 134/1.1 |

OTHER PUBLICATIONS

Yuan, et al "Numerical Modeling of a Low Temperature High Velocity Air Fuel Spraying Process with Injection of Liquid and Metal Particles", Journal of Thermal Spray Technology, vol. (15)(3) Sep. 2006, pp. 413-421.*

International Search Report and Written Opinion of the International Searching Authority dated Jul. 17, 2015 (International Application No. PCT/US2015/040898) 8 pages.

Zhetesova G. S. etal. Obespechenie prochnosti stsepleniya zaschitnykh gazotermicheskikh pokryty s osnovoi shtokov gidrotsilindrov mekhanizirovannykh krepei. Khabarshisy, Vestnik Kazakhskogo natsionalnogo tekhnicheskogo universiteta im. K. I. Satpaeva, 2014, No. 1 (101, p. 141-143.

P. Frauchais, "Understanding plasma spraying," journal, Apr. 14, 2004, 23 pages.

Currey et al., "Performance Testing of Suspension Plasma Sprayed Thermal Barrier Coatings Produced with Varied Suspension Parameters," article, journal, Jul. 24, 2015, 19 pages.

Currey et al., "Thermal Conductivity Analysis and Lifetime Testing of Suspension Plasma-Sprayed Thermal Barrier Coatings," article, journal, Aug. 15, 2014, 21 pages.

Vanevery et al., "Column Formation in Suspension Plasma-Sprayed Coatings and Resultant Thermal Properties," article, journal, Nov. 15, 2010, 12 pages.

Vanevery et al., Parametric study of suspension plasma spray processing parameters on coating microstructures manufactured from nanoscale yttria-stabilized zirconia, article, journal, Oct. 25, 2011, 10 pages.

Vanevery, "Development and Evaluation of Suspension Plasma Sprayed Yttria Stabilized Zirconia Coatings as Thermal Barriers," doctroal thesis, May 2009, 202 pages.

Stober et al., "Controlled Growth of Monodisperse Silica Spheres in the Micron Size Range," article, journal, Aug. 3, 1967.

European Search Report, International Application No. 15864746. 1-1010, dated Jul. 20, 2018 (11 pages).

* cited by examiner

THERMAL SPRAY METHOD INTEGRATING SELECTED REMOVAL OF PARTICULATES

CROSS-REFERENCE TO RELATED APPLICATIONS

This application is a continuation-in-part of U.S. patent application Ser. No. 14/458,694, filed Aug. 13, 2014, now abandoned, entitled PLASMA SPRAY APPARATUS INTEGRATING WATER CLEANING. U.S. patent application Ser. No. 14/458,694 is a continuation of U.S. patent application Ser. No. 13/826,252, filed Mar. 14, 2013, now abandoned, entitled PLASMA SPRAY APPARATUS INTEGRATING WATER CLEANING, which claims benefit and priority to U.S. Provisional Patent Application No. 61/639,471, filed Apr. 27, 2012, entitled PLASMA SPRAY APPARATUS INTEGRATING WATER CLEANING, the entire contents of which are incorporated herein.

BACKGROUND OF THE INVENTION

The present invention relates to integrating into a thermal spray system a method for the continuous in-flight reduction of suboptimal feedstock deposition and the in-situ removal of debris, such as less adherent feedstock and surface preparation grit particulates, from the substrate and coating.

Referring to FIGS. 1 and 1A of the drawings, conventional thermal spraying is a coating method wherein a continuous flow of hot gas 1 generated in chamber 2 is forced to pass through an ejection nozzle 3, forming a divergent gas column 4 having an axis 5. The column 4 is coaxial with the nozzle 3 and extends from the nozzle exit to a substrate surface 6 where the gas column 4 is projected into a surface spot 7. Due to atmospheric air entrainment into the fringes of the gas column, the temperature within the gas column follows a Gaussian profile 9 (FIG. 1) where the temperature decreases with distance from axis 5. Air entrainment into the fringes of the gas column also causes the velocity of the gas to decrease with distance from axis 5, following a similar Gaussian profile 9. Peak temperatures in the thermal spray gas column (near axis 5) may reach values in excess of 10,000 degrees Celsius, while gas velocities can range from several hundred meters per second to supersonic speeds. There are two main methods to heat the gas:

1) A combustion chamber where a mixture of a combustive gas and oxygen or air is ignited and ejected at supersonic (and subsonic) speeds through a nozzle.

2) A plasmatron comprising an arc chamber where an electric arc is struck between a cathode and an anode while a mixture of gases is continuously fed through the chamber. The gas mixture is heated by the electric arc and is ejected through a nozzle as a high temperature, high velocity plasma stream. One preferred plasmatron capable of issuing a high enthalpy (HE) plasma stream is shown in U.S. Pat. No. 6,114,649 of Delcea.

Feedstock material is injected into the gas column via one or more injectors 10. It becomes entrained in the gas column which transfers heat and momentum to the feedstock material, causing it to impact with high velocity onto the substrate surface where it adheres to form a coating 11. Thermal spray coatings adhere to the substrate primarily by physical forces. Because of this fact, the substrate surface is typically pre-treated prior to the coating process by means of blasting with high velocity abrasive particulates to increase the surface roughness and provide anchoring points onto which the coating can adhere. Additionally, the particulates impinging on the substrate must be in the optimal temperature and velocity ranges in order to attain a molten status and speed sufficient to deform into a lamellar structure—commonly referred to as a splat—during impact, which increases the ability to bond physically to the underlying surface. In order to form a coating of optimal thickness, more than one layer of splats is usually necessary; in this case several overlapping passes are performed. A pass generally consists of the gas column axis moving relative to surface 6 as shown by arrow 8.

In conventional thermal spraying, feedstock materials are generally powders of different coating materials in sizes between several microns to tens of microns. The powder is injected into the hot gas column, typically by using a carrier gas flow. The hot gas stream transfers heat and momentum to the powder, causing it to melt and impact on the substrate surface to form a coating. Due to technological and economic constraints, thermal spray powders have a relatively wide spread of particle sizes, which is problematic because larger particles require more heat and momentum to form splats during impact than smaller particles.

In suspension thermal spraying (STS), the feedstock material consists of particulates suspended in a liquid medium. A flow of this suspension is used to inject the feedstock material into the hot gas column; thus, the liquid medium replaces the carrier gas used in conventional thermal spraying. Compared to conventional thermal spray powders, these particulates are significantly smaller, generally in the submicron to nanometer range. A range of solid particulate sizes is also present in the suspensions, but this range is generally smaller than that of conventional thermal spray powders. Upon injection into the hot gas stream column, the liquid solvent of the suspension is evaporated by the heat of the gas column. Afterwards, heat and momentum continue to be transferred to the particulates, causing them to melt and impact onto the substrate surface to form a coating.

The particle size spread found in conventional powders and in suspension feedstock is deleterious for the spray process. Ideally, all feedstock particulates should be entrained and travel in the hottest and fastest core region of the gas column along axis 5. However, the injection methods—either carrier gas or liquid medium—typically impart approximately the same velocity to all feedstock particles. Consequently, as shown in FIG. 1 of the drawings, only feedstock particulates 12 that are optimally-sized to the injection and gas column conditions stay near axis 5 of the gas column 4, which results in them impacting the substrate with the temperature and velocity necessary to obtain a high quality coating. The largest, heaviest particles 13 tend to penetrate farther through the gas column 4 and travel outside the core region in the cooler and slower region of the gas column 4 opposite the feedstock injector 10. In the cooler, slower region, particles 13 do not receive enough heat and momentum to form splats upon impacting on the substrate, so they do not adhere well to the substrate and form suboptimal deposits an annular region surrounding the central area of high quality coating. The smallest and lightest feedstock particles 14 likewise form suboptimal deposits in an annular region surrounding the central area of high quality coating, because these particles cannot penetrate into the core of the gas column and travel instead in the fringes where the temperature and velocity are suboptimal. Since a coating is typically produced by overlapping passes to produce multiple deposition layers, the suboptimal deposits can get entrapped in the coating, lowering the coating adhesion and integrity. As a result, the coating strength will be improved by reducing the formation or entrapment in the coating of suboptimal deposits. The formation of suboptimal deposits can be reduced by increasing the fraction of particles in the feedstock that are optimally-sized; however, narrowing the particle size range tends to increase significantly the overall cost of the coating process. Alternatively, the entrapment of unwanted suboptimal deposits can be reduced by cleaning these deposits off the surface between coating passes.

The techniques commonly used to clean unwanted material off a surface prior to applying a thermal spray coating involve directing a jet of pressurized gas onto the surface. Often times a compressed jet alone does not provide sufficient cleaning; so, solid particulates, such as dry ice or abrasive ceramic grit, are added to the jet to provide a more aggressive cleaning. In the case of abrasive grit blasting, coated areas adjacent to the region to be cleaned generally need to be masked or shielded from the grit to prevent damage to the coating. Additionally, the grit blasting process leaves dust particulates on the surface that can become entrapped in the coating and lower the coating adhesion and integrity. With these blasting techniques, equipment separate from what is needed for the thermal spray coating application is used, resulting in additional expenditures for equipment capital, maintenance costs, and coating production time if the thermal spray process is interrupted while the blasting equipment cleans the unwanted material.

One may argue that the feedstock injection could be stopped, and the hot gas column could be used to remove suboptimal deposits off the surface without the need for separate equipment. This approach is not feasible because the heat from the gas can partially or fully melt the suboptimal deposits, which can cause an increase in the adhesion of the suboptimal material after it cools. Furthermore, even though the adhesion of the suboptimal deposits may be increased by the hot gas column, the physical bonding and surface finish resulting from this melting and cooling process will not be comparable to that produced by the high velocity impact of molten particles.

U.S. Patent Application Publication No. 2009/0324971 A1 to De Vries et al. teaches an atomic layer deposition technique. No feedstock is injected into the plasma in order to deposit a coating having identical chemical properties with the feedstock. Rather, mixtures of reactive gases are fed into a reaction chamber and the plasma is introduced separately to enhance the reaction rate. Ions from the gases chemically bond to the substrate to form atomic layers. Water vapors are then injected cyclically along the substrate surface as a reactive agent which bonds to the surface in either an additive or substitutional manner to change the surface chemistry. Thus, De Vries teaches using more reactive species to break randomly the existing chemical bonds of undesirable atoms/molecules on the surface, resulting in the more reactive species replacing the undesirable atom/molecules and changing the chemistry of the surface. The technique in De Vries is not transferrable to a thermal spray process where the bonding occurs by physical instead of chemical forces. For example, it is the inventors' belief that even if for some unknown reason one might be motivated to inject water vapors along the substrate surface while thermal spraying a coating as taught in De Vries, it is not obvious to do so since it would likely not result in suboptimal feedstock particles being cooled sufficiently to prevent adherence, nor would the water vapor velocity be able to remove loosely adhered suboptimal deposits.

U.S. Patent Application Publication No. 2008/0072790 to Ma et al. teaches a thermal spray system using a combustion chamber and a nozzle to eject a plume towards a substrate. Feedstock material consisting of liquid media, which can include mixtures of organic/inorganic metal salts or suspensions of small-sized solid particles in water or a volatile solvent, is injected into the plume. The water and the solid particles are pre-mixed as a unitary feedstock and are supplied to the plume as a mixture from the same reservoir. The suspension liquid including water is employed by Ma as a carrier for the solid particles solely because of the difficulties to feed fine particles (under 10 micrometers in size) using gas as a carrier (para 0007). Ma does not teach the injection into the plume of a liquid such as water segregated from the solid particulates in the plume, and no provisions to achieve such segregation are disclosed within the description of the embodiments. Furthermore, Ma does not teach liquid injection to modify the deposition characteristics or structure of the coating being formed.

U.S. Patent Application Publication No. 2004/0203251 to Kawaguchi et al. teaches that semiconductor wafer manufacturing can produce residue that will release ("outgas") gaseous reactants when exposed to atmospheric gases and water vapor. These reactants can cause contamination or corrosion issues to the part or processing equipment. (para 00026) To resolve this issue, Kawaguchi et al. describe using an apparatus generating a static, low temperature glow discharge plasma confined within a vacuum chamber to pre-heat the wafer containing the residue. (para 0031) Then, depending upon the residue chemistry, the wafer is exposed to an oxygen- or hydrogen-containing gas, either of which could be water vapor. (para 0029) This exposure releases the problematic reactants and converts them to into noncorrosive volatile species that are then removed from the vacuum chamber by pumping out the gases. (para 0030). The residue removal taught by Kawaguchi is in essence a reactive heat treatment performed statically under vacuum conditions and designed to convert the unwanted material into a gas. This process is specific to the chemistry and concerns of the semiconductor industry. Such a removal mechanism is not applicable to a thermal spray process performed in atmosphere with relatively nonreactive, non-chemically bonded debris that is best removed by mechanical dislocation, i.e. by the collision of particles with the debris.

U.S. Pat. No. 4,770,109 to Schlienger et al. teaches using a plasma torch, not to spray thermally-applied coating, but rather to heat and compact garbage onto a rotating disk located at the bottom of an incinerator chamber. After compaction and incineration, the treated garbage is emptied from the chamber, and the process is restarted. The torch is mounted through the upper lid of the incinerator with the plasma plume directed onto the rotating disk. The garbage to be treated can be in solid as well as liquid form. The solid and liquid garbage are not injected into the plasma plume; they are both fed through one pipe located away from the plasma plume (part 22 in the drawings and col 3 lines 6-7). Although Schlienger teaches feeding solid and liquid materials into a plasma produced by a plasma torch, the purpose of the process is to destroy the feedstock; therefore, Schlienger provides no provisions to be obviously usable in a thermal spray coating process which seeks to maximize the retention of the desired feedstock. Furthermore, Schlienger provides no provisions for a liquid to be injected directly into the plasma plume for the purpose of affecting the way feedstock particles are treated within the plume.

U.S. Patent Application Publication No. 2007/0084244 A1 to Rosenflanz et al. teaches the use of a plasma torch for treating feedstock materials for the purposes of producing amorphous or glass materials. Feedstocks of various ceramic particles are suspended in a carrier gas in order to be fed into the plasma plume. Once fed into the plasma plume of a given length, the feedstock particles are heated and melted into droplets. Rosenflanz makes no provision for also injecting a liquid into the plasma plume. Instead, Rosenflanz teaches spraying the plume and feedstock material into a liquid in order to cool the molten feedstock into particulates in the form of spheres or beads and separates this process from that of from producing a coating. (para 0104)

None of the above techniques or prior art provide a controlled in-situ removal of surface debris during a thermal spray coating process, while also reducing the deposition of suboptimal feedstock particulates in-flight. It should therefore be desirable to provide a thermal spray apparatus incorporating both of these means of avoiding the entrapment in the coating of particulates with suboptimal properties.

SUMMARY OF THE INVENTION

The present invention relates to integrating into a thermal spray system a method for the continuous in-flight reduction of suboptimal feedstock deposition and the in-situ removal of debris, such as less adherent feedstock and surface preparation grit particulates, from the substrate and coating.

In one aspect of the present invention, an integrated method is used to form a coating on a substrate surface. The method comprises providing a source of heated gas and a nozzle for shaping heated gas into a gas stream column coaxial with the nozzle, the column projecting into a spot on the substrate surface, and providing one or more injectors used to inject feedstock into the gas stream column and used to inject a liquid into the gas stream column; establishing a feedstock profile and determining a portion of the feedstock profile as optimal and the balance of the feedstock profile as suboptimal; determining two volumetric regions within the gas stream column, including one first region wrapped around the axis of the column and a second region surrounding the first region and coaxial with it, the first region projecting into a spot on the substrate surface and the second region projecting into an annular ring on the substrate surface, the annular ring coaxial with the spot and surrounding it; injecting feedstock into the gas stream column and adjusting the injection parameters to control the depth of feedstock penetration into the gas stream column so that the optimal feedstock is entrained within the first region of the stream while the suboptimal feedstock is entrained within the second region of the stream; injecting a liquid into the gas stream column and adjusting the injection parameters to control the depth of liquid penetration into the gas stream column so that the liquid is entrained substantially within the second region of the stream, the liquid reducing the temperature of the suboptimal portion of the feedstock entrained within the second region of the stream, and the temperature reduction being sufficient to reduce or prevent the suboptimal feedstock adherence on the substrate surface; injecting a liquid into the gas stream column and adjusting the injection parameters to control the depth of liquid penetration into the gas stream column so that the liquid is entrained substantially within the second region of the stream so that the liquid impacts the substrate removing debris on and embedded in the substrate; and forming a coating on the substrate surface by depositing feedstock substantially from within the spot projected on the surface by the first region of the gas stream column, the coating, thus, consisting substantially of feedstock deposited with optimal temperature and velocity conditions.

In another aspect of the present invention, a thermal spray apparatus adapted to form a coating on a substrate surface, comprises a source of heated gas; a nozzle for shaping heated gas into a gas stream column coaxial with the nozzle, the column adapted to project into a spot on the substrate surface; a plurality of injectors including at least one injector positioned to inject feedstock into the gas stream column and at least one injector positioned to inject a liquid into the gas stream column; the injectors being configured to establish a feedstock profile, with a first portion of the feedstock profile being optimal and the balance portion of the feedstock profile being suboptimal, the first portion and balance portion defining two volumetric regions within the gas stream column that include a first region wrapped around the axis of the column and a second region surrounding the first region and coaxial with it, the first region projecting into a spot on the substrate surface and the second region projecting into an annular ring on the substrate surface, the annular ring coaxial with the spot and surrounding it; and controls and valves connected to at least one of the injectors for injecting the feedstock into the gas stream column and adjusting the injection parameters to control the depth of feedstock penetration into the gas stream column so that the optimal feedstock is entrained within the first region of the stream while the suboptimal feedstock is entrained within the second region of the stream. The controls and valves are connected to at least one of the injectors for injecting a liquid into the gas stream column and for adjusting the injection parameters to control the depth of liquid penetration into the gas stream column so that the liquid is entrained substantially within the second region of the stream, the liquid reducing the temperature of the suboptimal portion of the feedstock entrained within the second region of the stream, and the temperature reduction being sufficient to reduce or prevent the suboptimal feedstock adherence on the substrate surface.

In a narrower form, the apparatus' controls and valves are configured to form a coating on the substrate surface by depositing the feedstock substantially from within the spot projected on the surface by the first region of the gas stream column, with the coating consisting substantially of the feedstock deposited with optimal temperature and velocity conditions.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
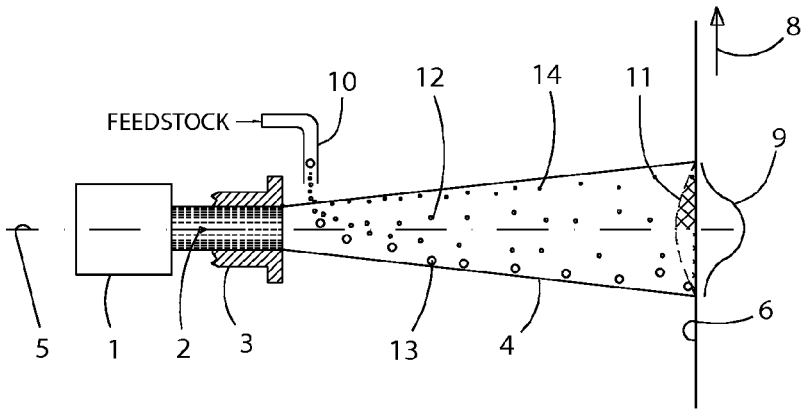
FIG. 1 (Prior Art)
FIGS. 1-1*a* are side and end views showing a general presentation of the conventional thermal spray process providing a hot gas column extending from a nozzle to a substrate surface, with the coating being deposited onto the substrate surface within the spot projected by the gas column onto the substrate surface.
Figure 1A:
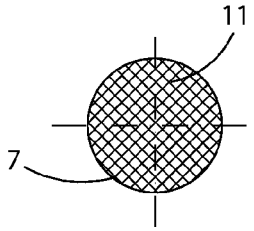
Figure 2:
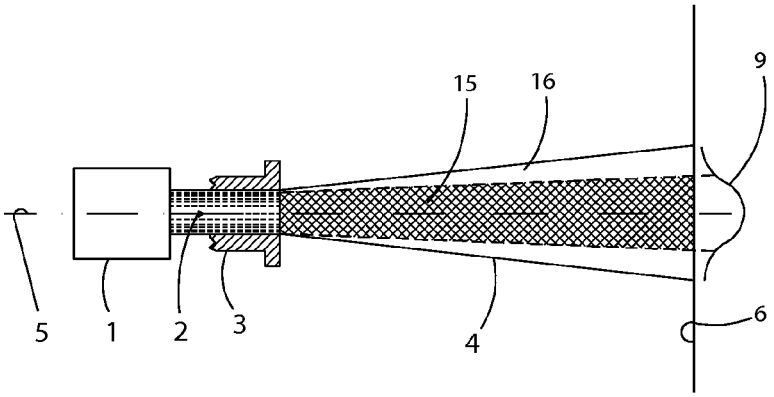
FIGS. 2-2*a* are side and end views showing a step in a preferred embodiment of the thermal spray method wherein two volumetric concentric regions are defined within the gas column, a hotter and faster first region 15 surrounding the axis 5 of the gas column, and a cooler and a slower second region 16 wrapped around region 15.
Figure 2A:
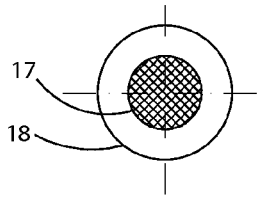
Figure 2B:
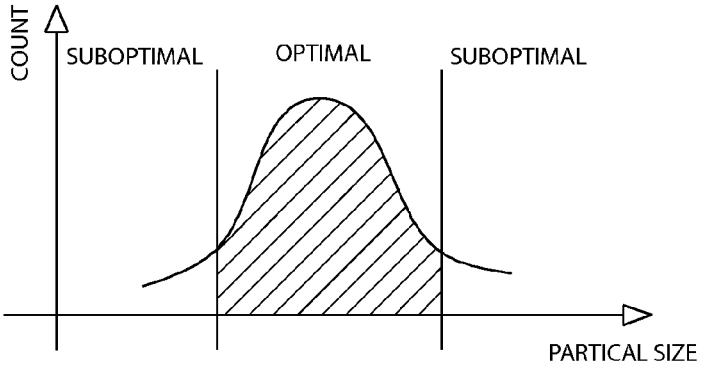
FIG. 2*b* is a graph showing particulate size versus count.

A thermal spray apparatus/system and a method are provided for the continuous in-flight reduction of suboptimal feedstock deposition and the in-situ removal of debris, such as less adherent feedstock and surface preparation grit particulates, from the substrate and coating. The apparatus (FIGS. 2-2*a*) includes a hot gas generator 2 and nozzle 3, which are used to generate a high temperature gas column 4 that projects into a spot onto the substrate surface 6. In an illustrative embodiment of the invention, the hot gas column properties, coating performance requirements, and feedstock characteristics combine to define an optimal feedstock size range; thus, any particle sizes outside this range would be classified as suboptimal, or undesirable. As mentioned above, a feedstock size distribution consisting only of particles within the optimal size is impractical. In practice, the most efficient scenario is to center the feedstock particle size distribution within the optimal size range, as shown schematically in FIG. 2*b*. Accordingly, within the gas column 4, the locations of the feedstock particle from each category define two volumetric regions: region 15 and region 16.

Region 15 surrounds axis 5 and projects onto the substrate surface 6 in a central spot 17. This region is characterized by the location of the optimal feedstock particles, meaning the particle temperature and velocity conditions generated in region 15 produce an optimal coating on the surface 6.

Region 16 surrounds region 15 and projects onto the substrate surface 6 in an annular region 18 that surrounds the central spot 17. Region 16 is characterized by the location of suboptimal feedstock particles; thus, the particle temperature and velocity conditions generated in region 16 are insufficient to produce an optimal coating on the surface 6. Consequently, region 18 is formed by the deposition of suboptimal particles.

Figure 3:
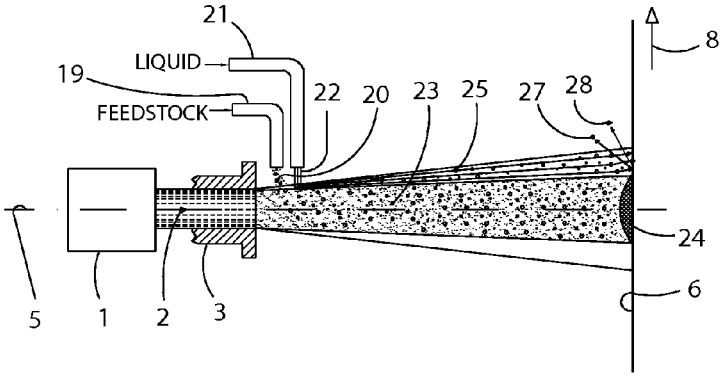
FIGS. 3-3*a* are side and end views showing one step in a preferred embodiment of the thermal spray system and method wherein feedstock is injected via injector 19, with the optimal feedstock particles being entrained within region 15 and the suboptimal particles being entrained within the upper portion of region 16. Also shown is liquid injector 21, which is used to inject liquid to become entrained substantially within the upper portion of the second region 16.
Figure 3A:
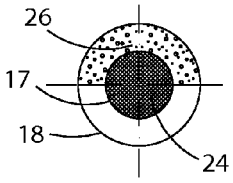

FIGS. 3-3*a* show an embodiment wherein the system comprises a first injector 19 to inject feedstock 20 into the gas column and a second injector 21 for injecting a liquid 22 into the gas column, with the second injector shown positioned downstream and adjacent to the first injector. For this embodiment, the feedstock particle size distribution is skewed, consisting only of particles in the optimal size range and smaller. Resultantly, the size of injector 19 and the speed of feedstock injection produce the penetration of the optimal feedstock particles 23 into region 15, while the suboptimal feedstock particles 25 are confined to the upper portion of region 16. The optimal feedstock particles 23 entrained in region 15 are transferred sufficient heat and momentum from the hot gas stream to impact substrate surface 6 and form an optimal quality coating 24, which is confined to the spot 17. The suboptimal feedstock particles 25 entrained in the upper portion of region 16 are cooled by liquid 22, which is primarily entrained into the upper portion of region 16 by adjusting the size of injector 21 and the speed of liquid injection. As shown in FIG. 3, the cooling produced by liquid 22 can reduce the degree of suboptimal feedstock particle melting to the point that splat formation is prevented, causing cooled suboptimal feedstock particles 27 to hit surface 6 and bounce off without adhering and forming a coating. Thus, liquid 22 and cooled suboptimal feedstock particles 27 can impact surface 6 and act as abrasive media, removing the weakly-adhered feedstock and grit particles represented by surface debris 26 ahead of the movement of spot 17 and the formation of coating 24. Furthermore, liquid 22 and cooled suboptimal feedstock particles 27 acting as abrasive media on surface 6 may dislodge embedded surface debris such as grit particles 28, removing them from the surface and preventing them from being entrapped in the coating. Moreover, it is possible that heating by the hot gas stream and cooling by the impinging liquid may cause the expansion and contraction of surface 6 and weakly-adhered/embedded debris particles 26 and 28, respectively, in a way that aids the removal of these debris particles from the surface. If an enhanced abrasive process is required, the liquid 22 may contain a suspension of fine abrasive particulates, such as silicon or aluminum oxides. The fine particulates would be entrained in the upper portion of region 16 where they would be accelerated towards surface 6 without achieving the velocity or degree of melting necessary to adhere to surface 6 upon impact. These fine particulates would therefore enhance the removal of debris 26 and 28.

Figure 4:
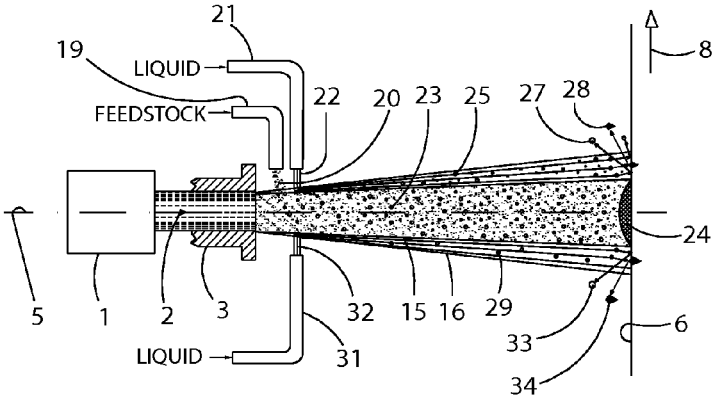
FIGS. 4-4*a* are side and end views showing another step in a preferred embodiment of the thermal spray system and method wherein feedstock is injected via injector 19, with the optimal particles being entrained within region 15 and the suboptimal particles being entrained within the upper and lower portions of region 16. Two opposed liquid injectors 21 and 31 are also shown; the injectors are used to inject liquid to become entrained substantially within the upper and lower portions of region 16, respectively.
Figure 4A:
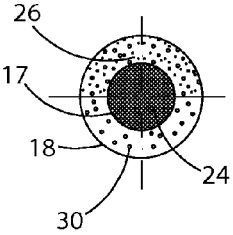

FIGS. 4-4*a* depict an embodiment where the feedstock particle size distribution is Gaussian and contains particles below and above the optimal size range. In this case, larger than optimal particles 29 injected with the feedstock stream 20 would penetrate through region 15 and become entrained in the lower portion of region 16. Because these particles 29 do not receive sufficient heat and momentum in region 16, they form a suboptimal deposit, represented by surface debris 30, which trails the movement of spot 17 and the formation of coating 24. As discussed here above with reference to FIG. 3, the smaller than optimal feedstock particulates 25 do not have enough momentum to penetrate into region 15. As a result, suboptimal feedstock particles 25 entrain in region 16 where they do not receive enough heat and momentum to form optimal coating 24 upon impacting surface 6, so instead suboptimal feedstock particles 25 add to surface debris 26. The negative situations associated with surface debris 26 and 30 are resolved by incorporating opposing liquid injectors 21 and 31, as shown in the preferred embodiment of FIG. 4. The size of injector 31 and the speed of injection are adjusted so that the entrainment of liquid 32 occurs substantially within the lower portion of region 16. Some particles 29 are then cooled by liquid 32 to impact the substrate with a degree of melting that is insufficient to adhere to the substrate; these cooled suboptimal feedstock particles 33 hit surface 6 and bounce off without adhering and forming a coating. Thus, liquid 32 and suboptimal feedstock particles 33 can impact surface 6 and act as abrasive media, removing weakly-adhered surface debris 30 in the portion of region 18 trailing the motion of the spot 17 and the formation of coating 24. This cleaning mechanism may also remove from surface 6, embedded debris such as grit particle 34. Moreover, it is possible that heating by the hot gas stream and cooling by the impinging liquid may cause the expansion and contraction of surface 6 and weakly-adhered/embedded debris particles 30 and 34, respectively, in a way that aids the removal of these debris particles from the surface.

With regards to the upper portion of region 16, the mechanism of action is the same as described here above with reference to FIG. 3. The cooling of suboptimal feedstock particles 25 in region 16 by liquid 22 reduces adherence to surface 6 upon impact. As shown in FIG. 4, some cooled suboptimal feedstock particles 27 hit surface 6 and bounce off without adhering at all. Thus, liquid 22 and suboptimal feedstock particles 27 can impact surface 6 and act as abrasive media, removing the weakly-adhered feedstock and grit particles represented by surface debris 26 ahead of the movement of spot 17 and the formation of coating 24. Furthermore, liquid 22 and suboptimal feedstock particles 27 acting as abrasive media on surface 6 may dislodge embedded surface debris, such as grit particle 28, removing them from the surface and preventing them from being entrapped into the coating. Moreover, it is possible that heating by the hot gas stream and cooling by the impinging liquid may cause the expansion and contraction of surface 6 and weakly-adhered/embedded debris particles 26 and 28, respectively, in a way that aids the removal of these debris particles from the surface.

Figure 5:
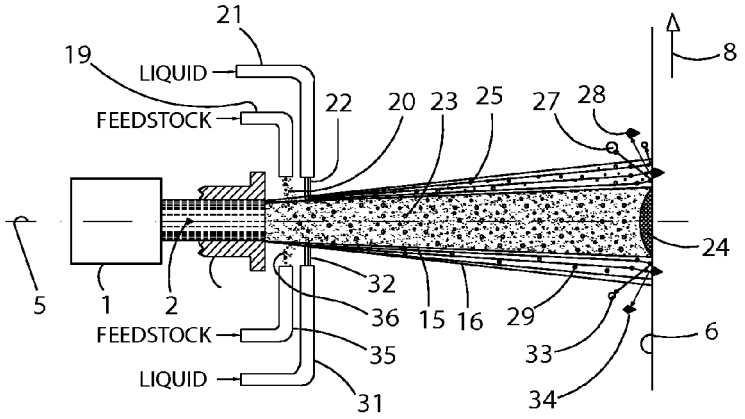
FIGS. 5-5*a* are side and end views showing another step in a preferred embodiment of the thermal spray system and method wherein feedstock is injected via opposed injectors 19 and 25, with the optimal particles being entrained within region 15 and the suboptimal particles being entrained within the upper and lower portions of region 16. Two opposed liquid injectors, 21 and 31 are also shown; these injectors are used to inject liquid to become entrained substantially within the upper and lower portions of region 16.
Figure 5A:
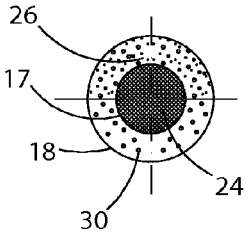

When increased output requires larger volumes of feedstock to be injected, multiple feedstock injectors can be distributed about axis 5 of the gas stream. FIGS. 5 and 5*a* of the drawings presents another preferred embodiment of the system shown in FIG. 4 with an additional feedstock injector 35 being located opposite to feedstock injector 19. The mechanism of injection and removal of suboptimal particulates and surface debris is a mirror of the mechanisms described for the embodiments shown in FIG. 3 and FIG. 4.

Figure 6:
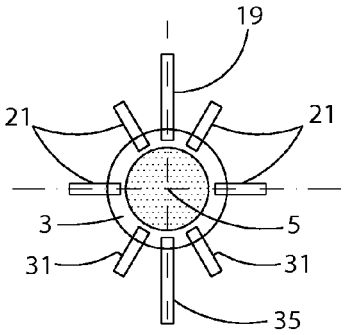
FIG. 6 shows a schematic front view of the nozzle 3 with a plurality of feedstock injectors 19 and 25 and a plurality of liquid injectors 21 and 31 arranged about axis 5.

In another embodiment of the present invention, FIG. 6 of the drawings shows a schematic front view of nozzle 3 with a plurality of feedstock injectors 19 and 35 and a plurality of liquid injectors 21 and 31 arranged about axis 5.

Figure 7:
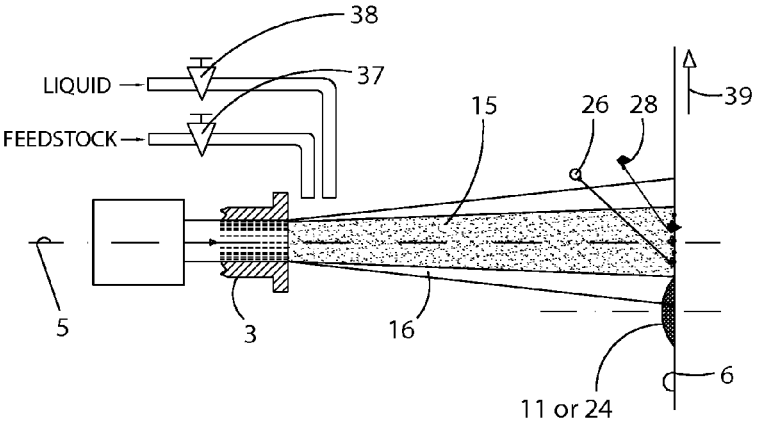
FIGS. 7-7*a* are side and end views showing a preferred embodiment of the method wherein a coating is deposited and the substrate surface is cleaned by alternate steps of the method described in the invention.
Figure 7A:
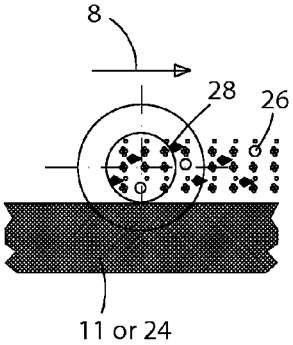

Another preferred embodiment of the thermal spray system incorporating the invention is shown schematically in FIGS. 7 and 7*a* of the drawings. The gas stream column is shown extending from nozzle 3 to substrate surface 6, the column having a defined core region 15 surrounding axis 5. Feedstock injector 19 is shown having flow control valve 37. Similarly, liquid injector 21 is shown having flow control valve 38. One of each injector is shown in FIG. 7; however, only one injector connected to both control valves 37 and 38 could be incorporated, or a plurality of injectors arranged about axis 5 may be employed as previously described with reference to FIG. 6. For the embodiment shown in FIG. 7, in a first step, the thermal spray system moves relative to surface 6 parallel to arrow 8 to deposit one or multiple layers of coating 11 or 24 in a manner described here above with reference to FIG. 1, 3, 4, or 5. In a second step, feedstock flow is stopped with valve 37, and the liquid velocity is adjusted with valve 38 so that the liquid is entrained substantially within region 15 of the gas stream. In a third step the thermal spray system moves relative to surface 6 in the direction(s) of arrow 8 and/or arrow 39 to clean debris particles 26 and 28 from surface 6 and coating 11 or 24 according to the method described here above with reference to FIG. 3, 4, or 5. In a fourth step, control valve 37 is opened and the feedstock and liquid flows are adjusted to deposit one or multiple layers of coating 11 or 24 in a manner described here above with reference to FIG. 1, 3, 4, or 5.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. An integrated method of providing controlled in-situ removal of surface debris comprising weakly-adhered feedstock and grit particles during a thermal spray coating process used to form a coating on a substrate surface, comprising:

providing a source of heated gas and a nozzle for shaping heated gas into a gas stream column coaxial with the nozzle, the gas stream column extending in a downstream direction away from the nozzle and projecting onto the substrate surface;

providing a feedstock injector that is configured to inject feedstock into a first side of the gas stream column;

providing a liquid injector that is configured to inject liquid water that does not contain feedstock into the first side of the gas stream column transverse to the gas stream column;

providing feedstock having a particle size distribution;

establishing a feedstock profile corresponding to the particle size distribution;

determining a portion of the feedstock profile as optimal for forming lamellar structure on a substrate and the balance of the feedstock profile as suboptimal to permit at least some of the suboptimal feedstock to clean abrasively when the suboptimal feedstock is cooled by liquid water injected transverse to the gas stream column;

determining two volumetric regions within the gas stream column, including a first region wrapped around the axis of the column and a second region surrounding the first region and coaxial with it, the first region projecting into a spot on the substrate surface and the second region projecting into an annular ring on the substrate surface, the annular ring coaxial with the spot and surrounding it, wherein the first region is hotter and faster than the second region and extends continuously from the nozzle to the substrate surface and heats the substrate surface;

moving the gas stream column relative to the substrate surface whereby the spot and the annular ring move relative to the substrate surface;

injecting feedstock into the gas stream column from the feedstock injector and adjusting injection parameters of the feedstock injected by the feedstock injector to control a depth of feedstock penetration into the gas stream column so that the optimal feedstock is entrained within the hotter and faster first region of the stream while the suboptimal feedstock is entrained within the second region of the stream;

injecting liquid water that does not contain feedstock into the gas stream column from the liquid injector downstream of the feedstock injector in a direction that is transverse to the gas stream column and adjusting injection parameters of the water from the liquid injector to control, separately from the adjustment of the feedstock injection parameters, a depth of water penetration into the gas stream column transverse to the gas stream column so that the water is entrained substantially within the second region of the stream without penetrating the hotter and faster first region, the water reducing the temperature of the suboptimal portion of the feedstock entrained within the second region of the stream, and the temperature reduction being sufficient to prevent adherence of at least some suboptimal feedstock entrained within the second region of the stream on the substrate surface, wherein at least some of the suboptimal feedstock impacts the substrate surface and acts as abrasive media and removes weakly-adhered feedstock and grit particles of surface debris to prevent the weakly-adhered feedstock and grit particles of surface debris from being entrapped in a coating formed by the optimal feedstock to provide a cleaned substrate surface ahead of the spot on the substrate surface;

wherein the injection parameters of the liquid water are also adjusted separately from the adjustment of the feedstock parameters so that liquid water impacts the substrate removing debris on the substrate; and forming a coating on the substrate surface by depositing feedstock substantially from within the spot projected on the surface by the hotter and faster first region of the gas stream column, wherein the hotter and faster first region extends to the substrate surface such that the optimal feedstock has optimal temperature and velocity and attains a molten status and speed sufficient to deform into a lamellar structure when the optimal feedstock impinges on the cleaned substrate surface, the coating, thus, consisting substantially of optimal feedstock deposited with optimal temperature and velocity conditions and forming lamellar structures.

2. The method as described in claim 1 further comprising;

stopping the feedstock flow;

adjusting pressure and velocity of the liquid water such that the liquid water penetrates the first region of the gas stream column; and:

moving the column over one or both of the coating and surfaces adjacent to the coating for the purpose of removing debris.

3. The method as described in claim 1 wherein:

the source of heated gas is a combustion chamber.

4. The method as described in claim 3 wherein:

the feedstock is in the form of a slurry comprising a liquid containing suspended fine particles of coating material.

5. The method as described in claim 1 wherein:

the source of heated gas is a plasmatron.

6. The method as described in claim 5 wherein:

the feedstock is in the form of a slurry comprising a liquid containing suspended particles of coating material.

7. The method as described in claim 1 wherein:

the feedstock is a slurry comprising a liquid containing suspended particles of coating material.

8. The method as described in claim 1 wherein:

the water contains suspended abrasive particulates and the conditions are adjusted such as not to cause the adherence of the abrasive particulates.

9. The method as described in claim 1 wherein:

the liquid injector is directly adjacent the feedstock injector.

10. The method as described in claim 1, wherein:

the liquid injector and the feedstock injector inject liquid and feedstock, respectively, in directions that are parallel to one another.

11. The method as described in claim 1, wherein:

the nozzle includes an end face and an aperture in the end face forming an exit, wherein the gas stream column exits the nozzle at the exit; and wherein:

the feedstock injector is spaced apart from the exit and end face in a downstream direction to form a gap.

12. The method as described in claim 1, wherein:

the feedstock profile is Gaussian and the optimal feedstock profile comprises a range of particle sizes having upper and lower bounds, wherein the suboptimal feedstock profile comprises particle sizes above and below the upper and lower bounds, respectively;

the liquid injector comprises a first liquid injector; and including:

providing a second liquid injector that is located on an opposite side of the gas stream column relative the first liquid injector;

adjusting the size of the first liquid injector and the speed of liquid injected from the first liquid injector such that liquid from the first liquid injector is entrained substantially in a first portion of the second region on the first side of the gas stream column without reaching the first region;

adjusting the size of the second liquid injector and the speed of liquid injected from the second liquid injector and the speed of liquid injected from the second liquid injector such that liquid from the second liquid injector is entrained substantially in a second portion of the second region that is on a second side of the gas stream column opposite the first side;

adjusting feedstock injection such that the suboptimal feedstock particles having sizes below the lower bound are entrained in the first portion of the second region on the first side of the gas stream column and abrasively clean the substrate surface ahead of the spot on the substrate surface, and the suboptimal particles having sizes above the upper bound pass through the first portion of the second region on the first side of the gas stream column and through the gas stream column, and wherein the suboptimal particles having sizes above the upper bound are entrained in the second portion of the second region on the second side of the gas stream column and act as abrasive media trailing the spot and remove surface debris from the coating formed within the spot.

13. The method as described in claim 1, wherein:

the feedstock is injected in a direction that is transverse to the gas stream column.

* * * * *